United States Patent [19]

Tullis

[11] Patent Number: 4,697,083

[45] Date of Patent: Sep. 29, 1987

[54] ION DETECTOR

[75] Inventor: Andrew M. Tullis, Livermore, Calif.

[73] Assignee: The United States of America as represented by the Department of Energy, Washington, D.C.

[21] Appl. No.: 824,037

[22] Filed: Jan. 30, 1986

[51] Int. Cl.[4] ..... H01J 47/02

[52] U.S. Cl. ..... 250/374; 250/386

[58] Field of Search ..... 250/374, 386, 387; 313/51, 93

[56] References Cited

U.S. PATENT DOCUMENTS

| | | | |
|---|---|---|---|
| 2,962,615 | 11/1960 | Anton | 313/93 |
| 4,163,152 | 7/1979 | Suzuki | 250/374 |
| 4,384,233 | 5/1983 | Colgan | 313/51 |

*Primary Examiner*—Janice A. Howell
*Assistant Examiner*—Constantine Hannaher
*Attorney, Agent, or Firm*—L. E. Carnahan; Roger S. Gaither; Judson R. Hightower

[57] ABSTRACT

An improved ion detector device of the ionization detection device chamber type comprises an ionization chamber having a central electrode therein surrounded by a cylindrical electrode member within the chamber with a collar frictionally fitted around at least one of the electrodes. The collar has electrical contact means carried in an annular groove in an inner bore of the collar to contact the outer surface of the electrode to provide electrical contact between an external terminal and the electrode without the need to solder leads to the electrode.

19 Claims, 4 Drawing Figures

ION DETECTOR

The invention described herein arose in the course of, or under, Contract No. W-7405-ENG-48 between the U.S. Department of Energy and the University of California.

BACKGROUND OF THE INVENTION

The invention relates to an improvement in ion detectors. More particularly, this invention relates to an improved electrical connection to the anode or cathode of an ionization chamber type of ion detector.

The presence of radioactive materials which emit beta particles during decay can be detected using an ion detection device such as an ionization chamber which detects the ionization of a gas in the chamber by beta emission. The ionization chamber comprises a gas filled housing containing an anode and a cathode to which any ionization in the gas is swept by the electric field produced by the electrodes.

Tritium, which has a half-life of 12.26 years and undergoes natural radioactive decay through beta emission at 18.6 keV maximum energy with an average energy of 5.69 keV, may be detected using such an ion detection device. Such tritium detectors are, in fact, widely used in some facilities where radioactive materials are handled.

Such detectors commonly comprises a housing having therein a central rod or tube which comprises one electrode surrounded by a hollow cylindrical jacket which forms the other electrode. Electrical connection is usually made to one or both of the electrodes by soldering wire leads to the electrode, e.g., the anode, which interconnects the anode with an external terminal on the device.

This type of electrical connection, however, creates problems. The use of a solder connection to the electrodes results in an assembly which is difficult to remove for cleaning purposes and can result in the generation of various outgas contaminants. Since the process for cleaning and reassembling the devices is potentially hazardous and must be performed in a glove-box, elimination of the solder attachment to the electrode, which would simplify cleaning and assembly of the device, would be advantageous.

SUMMARY OF THE INVENTION

It is, therefore, an object of this invention to provide an improved ion detector of the ionization chamber type wherein electrical connection is made to the electrodes in a manner which permits easy cleaning and reassembling of the device.

It is another object of this invention to provide an improved ion detector of the ionization chamber type having solderless electrical connections to the electrodes.

It is a further object of this invention to provide an improved ion detector of the ionization chamber type wherein electrical connection is made to one or more of the electrodes via a collar containing a conducting member which fits around the electrode.

These and other objects of the invention will be apparent from the following description and accompanying drawings.

In accordance with the invention an improved ionization detection device comprises an ionization chamber having a central electrode therein surrounded by a cylindrical electrode member within the chamber wherein a collar is frictionally fitted around at least one of the electrodes having electrical contact means carried in a groove therein to contact the outer surface of the electrode.

DETAILED DESCRIPTION OF THE INVENTION

Figure 1:
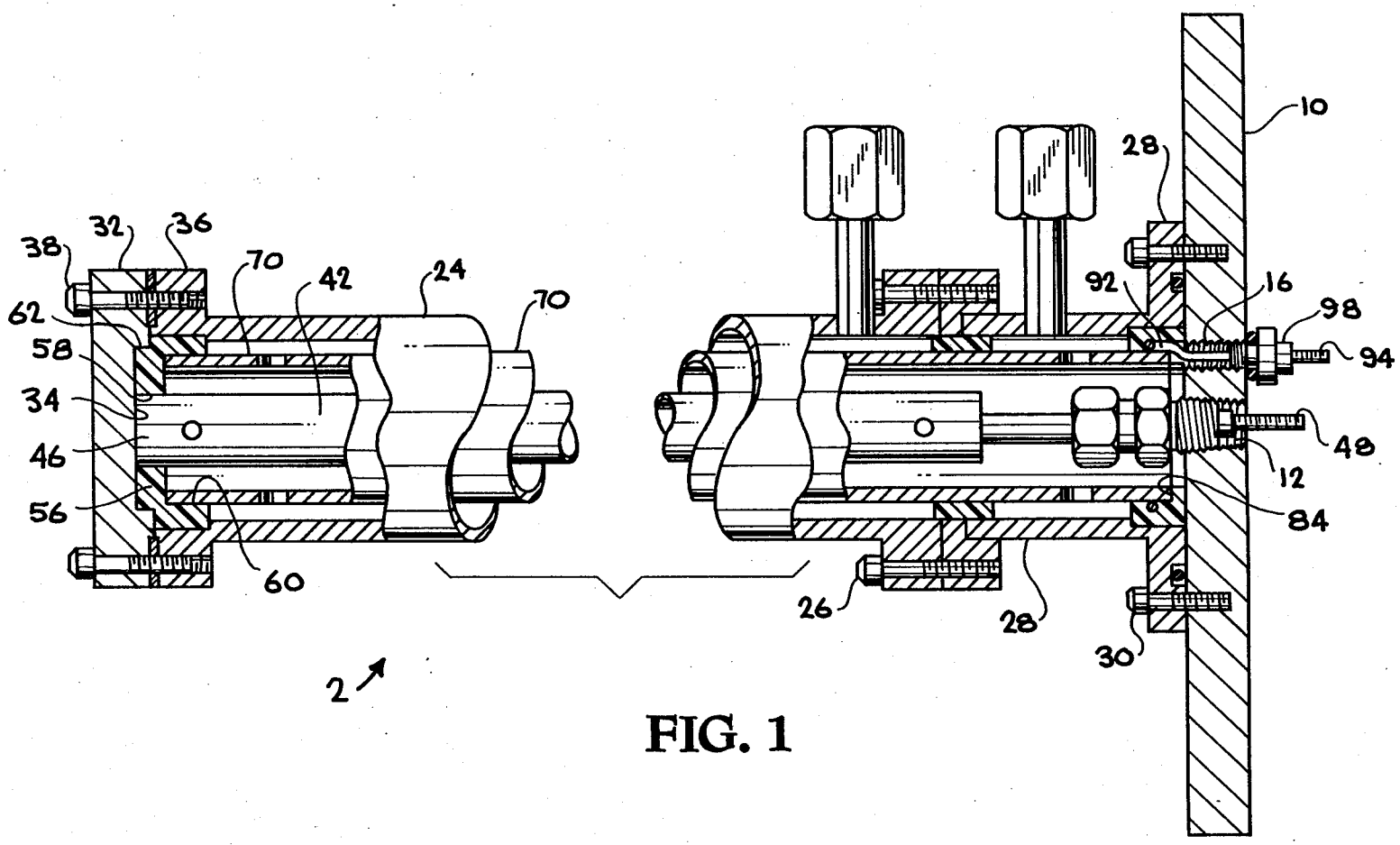
FIG. 1 is a side-sectional view of the improved ionization chamber of the invention.

Referring now to FIG. 1, the improved ionization chamber of the invention is generally shown at 2 comprising an outer cylindrical jacket or housing 24 which is fastened at 26 to a first flange 28 mounted via bolts 30 to a chamber plate 10. Coaxially mounted within outer jacket 24 of ionization chamber are a central electrode 42 and a cylindrical electrode 70 as will be described below.

Outer jacket 24 is provided with a second flange 36 at the opposite end of jacket 24 to which is mounted an end plate 32 via bolts 38. End plate 32 has a recessed central portion 34 which receives a raised central portion 62 of a mounting collar or spacer 56 which comprises an insulating member, e.g., Teflon, to space the cathode and anode of the ionization chamber from one another. Bore 58 in spacer 56 and opening 12 in chamber plate 10 serve to centrally locate a tubular electrode 42 along the axis of cylindrical jacket or housing 24.

Central tubular electrode member 42, which may be hollow or solid, is shown as a hollow member having a metal plug 44 fitted into a first end thereof. The opposite end 46, of electrode member 42 is received into central bore 58 of spacer 56. Electrode member 42 and plug 44 are preferably metallurgically fastened thereto by brazing or the like. A central wire or rod 48 is, in turn, received in a central opening in plug 44 and metallurgically fastened to plug 44 by brazing or the like.

A Teflon sleeve 50 is fitted around wire 48 and the sleeve-covered wire is inserted in central bores in gland nut 52 and threaded insert 54. Insert 54 is threadedly received in central opening 12 in chamber plate 10 so that the end of wire 48 protrudes out the other side of chamber plate 10 to permit electrical connection thereto to establish electrical communication with electrode 42. After mounting threaded insert 54 in bore 12, gland nut 52 is tightened to compress Teflon sleeve 50 tightly around wire 48 to thereby secure the mounting of electrode 42 to chamber plate 10.

In the illustrated embodiment, tubular electrode 42 is at ground potential with respect to electrode 70 which is at −1000 VDC. However, Teflon sleeve 50 insulates tubular electrode 42 from chamber plate 10. Furthermore, the extension of wire 48 through opening 16 in chamber plate 10 may be threaded to receive a nut thereon (not shown), which permits electrical connection to electrode 42 without the need for a solder connection.

The other electrode in ionization chamber 2 comprises a metal jacket or cylindrical electrode 70 of smaller diameter than outer jacket 24. Cylindrical electrode 70 is coaxially mounted in chamber 2 around central tubular electrode 42 at one end via an enlarged bore 60 in spacer member 56 and at the opposite end by a spacer or collet 74 which also provides the electrical connection to cylindrical electrode 70 in accordance with the invention.

Collet 74 comprises a somewhat resilient insulating material such as Teflon or equivalent material. Collet 74 is formed with a central opening 76 of sufficient diameter to permit passage therethrough of central tube electrode 42. Collet 74 is further provided with an enlarged bore 78 of a diameter slightly larger than the diameter of cylinder electrode 70 which is received therein. Bore 78 terminates in a shoulder 84 against which the end of electrode cylinder 70 abuts. The outer dimensions of collet 74 is chosen to permit it to be snugly fitted inside outer jacket 24 to thereby maintain jacket 24 and cylindrical electrode 70 in concentrically spaced relationship.

An annular groove 80, preferably of semicircular cross-section, is formed in the side wall 82 of bore 78 of collet 74 in accordance with the invention. Into annular groove 80 is placed a wire 90. Lead 92, which may comprise a continuation of wire 90, provides external electrical connection to wire 90 by passing through an insulating grommet 98 mounted in a second opening 16 in chamber plate 10. Lead 92 may be threaded at the end 94 protruding from grommet 98 to permit attachment of a nut (not shown) thereon to facilitate further electrical connection thereto. Wire 90 and lead 92 may comprise a cadmium plated copper wire having a diameter approximately equal to the width of groove 80 to permit wire 90 to snugly fit therein.

Electrical contact is made to cylindrical electrode cylinder 70 by inserting electrode 70 into bore 78 of collet 74 until it rests against shoulder 84. The resilience of collet 74 will urge wire 90 into contact with the outer surface of cylindrical electrode 70 since the outer diameter of electrode 70 is only slightly smaller than the diameter of bore 78 in collet 74. For example, when the outer diameter of cylindrical electrode 70 is $1.300 \pm 0.002$ inches, the diameter of bore 78 in collet 74 will be $1.305 \pm 0.003$ inches and the diameter of wire 90 (and the width of groove 80) will be $0.062 \pm 0.002$ inches. Thus bore 78 may range from about 0.001 to about 0.010 inches larger in diameter than said cylindrical electrode. Preferably, however, bore 78 is from about 0.003 to 0.008 inches larger in diameter than said cylindrical electrode, and most preferably about 0.005 inches larger in diameter.

Figure 3:
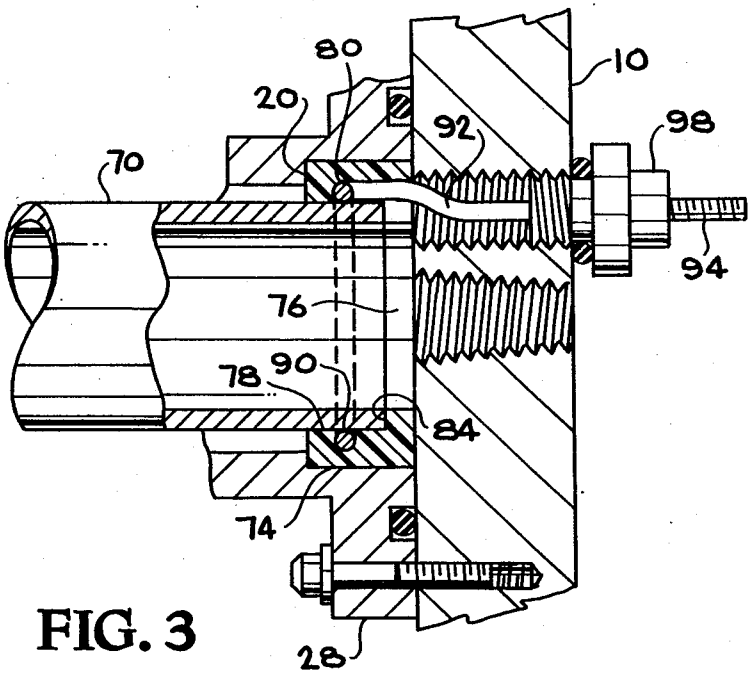
FIG. 3 is a a fragmentary side-section view of a portion of the chamber of FIG. 1.
Figure 2:
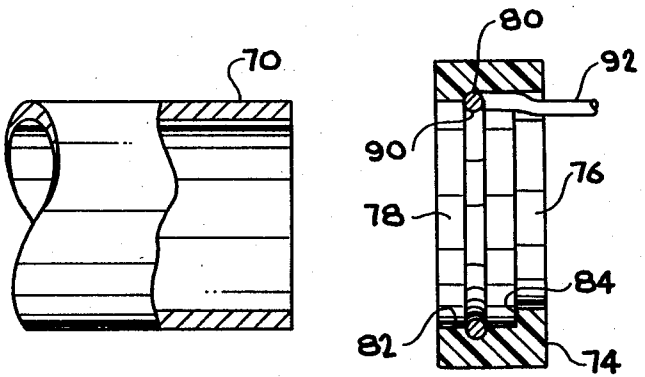
FIG. 2 is an exploded side-sectional view of a portion of the chamber of FIG. 1.
Figure 4:
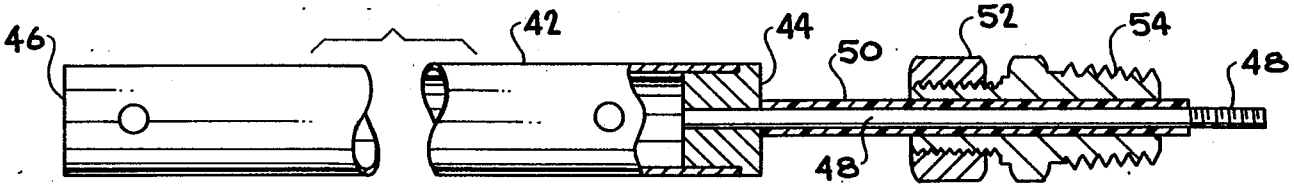
FIG. 4 is a fragmentary side-section view of another component in the chamber of FIG. 1.

Collet 74 may be retained in position in the ionization chamber by providing an inner shoulder 20 on flange 28 to engage the outer surface of collet 74 as best seen in FIG. 3.

When initially assembling ionization chamber 2, flange 28 and outer jacket 24 may be bolted to chamber plate 10 around collet 74 with lead 92 and grommet 98 already mounted on chamber plate 10. Cylindrical electrode 70 may then be inserted into collet 74, and then collar 56 and end plate 32 mounted to the opposite end of jacket 24.

To disassemble the device, end plate 32 and mounting collar 56 are first removed and then cylindrical electrode 70 may be removed from collet 74 by simply grasping the electrode and sliding it out of collet 74. Cylindrical electrode 70 may then be either cleaned or replaced without any need to solder or unsolder connections to the electrode. The cleaning and/or replacement of electrode 70 is thus rendered both easier and safer in accordance with the invention.

Thus, the invention provides an improved ion detector device of the ionization chamber type wherein one or both electrodes of the device may be electrically connected to external terminals without the need for solder connections to the electrodes. The device may then be easily disassembled for cleaning or replacement of the electrodes. Outgassing due to solder joints is thereby eliminated. Furthermore, when working with radioactive materials, the ease of assembly and disassembly reduces the necessary handling of the components and thus provides an added measure of safety.

While a specific embodiment of the improved ion detector has been illustrated and described in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. An improved ionization detection device comprising:
   - an ionization chamber;
   - a central electrode within said chamber;
   - a cylindrical electrode member within said chamber; and
   - a collet frictionally fitted around at least one of said electrodes, said collet having electrical contact means carried in a groove therein to contact a surface of at least one of said electrodes.

2. The device of claim 1 wherein said central electrode comprises an elongated tubular member.

3. The device of claim 2 wherein said cylindrical electrode is coaxially spaced around said central tubular electrode.

4. The device of claim 3 wherein said collet is fitted over said cylindrical electrode.

5. The device of claim 4 wherein said electrical contact means in said groove in said collet contacts the outer surface of said cylindrical electrode.

6. The device of claim 3 wherein said collet is located adjacent one end of said ionization chamber and spacer means located adjacent an opposite end of said chamber cooperate with said collet to coaxially space said cylindrical electrode from said central electrode.

7. The device of claim 6 wherein said collet is retained in said chamber by shoulder means associated with said chamber which engage a portion of said collet.

8. The device of claim 1 wherein said electrical contact means comprise a wire in said groove.

9. The device of claim 8 wherein said wire means in said groove communicate with electrical connection means external to said chamber such that electrical connection may be made to one or more of said electrodes without fastening leads to said electrodes.

10. The device of claim 9 wherein said electrical connection means comprise an extension of said wire which pass through an insulating grommet in a wall of said chamber.

11. The device of claim 8 wherein said groove is semicircular in cross-section having a diameter approximately equal to the diameter of said wire.

12. An ionization detection device of the ionization chamber type comprising:

a cylindrical housing having a first end plate mounted on one end thereof and a second end plate mounted to the other end of said cylindrical housing:

a cylindrical electrode concentrically mounted within said cylindrical housing;

a tubular electrode centrally mounted in said chamber coaxial to said cylindrical housing and said cylindrical electrode;

first spacer means adjacent one end of said chamber to separate said cylindrical housing, cylindrical electrode, and central tubular electrode in spaced relationship to one another;

second spacer means mounted between at least said cylindrical housing and said cylindrical electrode;

a bore within said second spacer means having a diameter slightly larger than the outer diameter of said cylindrical electrode; and electrical contact means carried in an annular groove in said bore of said second spacer means capable of making electrical contact to said cylindrical electrode when said electrode is inserted into said bore of said spacer.

13. The device of claim 12 wherein said electrical contact means comprise a metal wire carried in said annular groove.

14. The device of claim 13 wherein said groove is semicircular in cross-section having a diameter approximately equal to the diameter of said metal wire.

15. The device of claim 14 wherein a portion of said metal wire passes through a grommet insulator in an opening in one of said end plates to provide external electrical communication to said cylindrical electrode.

16. The device of claim 14 wherein said bore in said second spacer means is from about 0.001 to 0.010 inches larger in diameter than said cylindrical electrode.

17. The device of claim 16 wherein said bore in said second spacer means is from about 0.003 to 0.008 inches larger in diameter than said cylindrical electrode.

18. The device of claim 16 wherein said wire has a diameter of approximately 0.062 inches ±0.002.

19. An improvement in an ionization chamber of an ion detection device comprising:

a cylindrical housing having a first end plate mounted on one end thereof and a second end plate mounted to the other end of said cylindrical housing;

a first electrode centrally mounted in said chamber along the axis of said cylindrical housing extending from said first end plate to said second end plate;

a hollow cylindrical electrode coaxially mounted within said cylindrical housing along the axis of said central electrode;

first insulating spacer means adjacent one end of said chamber to coaxially separate and insulate said cylindrical electrode from said cylindrical housing and said central electrode;

second insulating spacer means mounted between at least said cylindrical housing and said cylindrical electrode;

a bore within said second spacer means having a diameter slightly larger than the outer diameter of said cylindrical electrode;

a metal wire carried in an annular groove in said bore of said spacer capable of making slidably detachable electrical contact to said cylindrical electrode when said electrode is inserted into said bore of said spacer; and terminal means mounted on one of said end plates and electrically connected to said wire in said groove to thereby provide external electrical communication to said cylindrical electrode without attaching leads to said electrode such that said chamber may be disassembled and said electrodes cleaned or replaced without the need to resolder leads to said electrodes.

* * * * *